US006381422B1

(12) United States Patent
Tanaka

(10) Patent No.: US 6,381,422 B1
(45) Date of Patent: Apr. 30, 2002

(54) IMAGE FORMING APPARATUS FOR FINE-ADJUSTING A FIXATION SPEED OF A DEVELOPMENT MATERIAL IN ACCORDANCE WITH TEMPERATURE CONTROL

(75) Inventor: Toshiaki Tanaka, Fukaya (JP)

(73) Assignee: Toshiba Tec Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/629,796

(22) Filed: Jul. 31, 2000

(51) Int. Cl.[7] ..... G03G 15/00; G03G 15/20

(52) U.S. Cl. ..... 399/45; 399/68; 399/69; 399/389

(58) Field of Search ..... 399/45, 67, 68, 399/69, 389, 396

(56) References Cited

U.S. PATENT DOCUMENTS

| | | | | |
|---|---|---|---|---|
| 4,549,803 A | * | 10/1985 | Ohno et al. | 399/45 |
| 5,689,760 A | * | 11/1997 | Suzuki et al. | 399/45 |
| 6,112,037 A | * | 8/2000 | Nagata et al. | 399/45 |
| 6,219,498 B1 | * | 4/2001 | Katoh et al. | 399/45 |

FOREIGN PATENT DOCUMENTS

| | | |
|---|---|---|
| JP | 6-138789 | 5/1994 |
| JP | 7-219292 | 8/1995 |
| JP | 8-220928 | 8/1996 |

* cited by examiner

*Primary Examiner*—Sandra Brase
(74) *Attorney, Agent, or Firm*—Foley & Lardner

(57) ABSTRACT

An image forming apparatus controls a fixation speed by fine adjustment in accordance with control of a fixation temperature. Its structure comprises: a medium supply unit for supplying an image forming medium at a constant supply speed; an image formation unit for forming a predetermined image by using a development material based on inputted image information and holding it by an image bearer; a carriage unit for carrying the image forming medium supplied to the image formation unit; a transfer unit for transferring the development material formed as an image on the image bearer by the image formation unit onto the image forming medium; a fixation unit for heating and fusing the transferred development material by a heating member and fixing the development material on the image forming medium; and a control element which controls a medium supply speed of the medium supply unit, a medium carriage speed of the carriage unit, and an optimum fixation temperature of the fixation unit in accordance with a type, a material and a thickness of the image forming medium and fine-adjusts a fixation speed of the heating member for carrying the image forming medium while following the fixation temperature whose setting changes in accordance with a type, a material and a thickness of the image forming medium.

12 Claims, 7 Drawing Sheets

IMAGE FORMING APPARATUS FOR FINE-ADJUSTING A FIXATION SPEED OF A DEVELOPMENT MATERIAL IN ACCORDANCE WITH TEMPERATURE CONTROL

BACKGROUND OF THE INVENTION

The present invention relates to an image forming apparatus applicable to a copier, a printer and the like, and more particularly to an image forming apparatus for fine-adjusting a fixation speed of a development material in accordance with temperature control for fusing and fixing the development material.

DESCRIPTION OF THE PRIOR ART

In general, an image forming apparatus prints and records image information supplied from an image information supplying device such as a personal computer (which will be referred to as PC hereinafter) or a digital camera onto paper such as plain paper or an OHP sheet and can be applied to, for example, a color plain paper copy machine (which will be referred to as PPC hereinafter) or a printer. It is to be noted that paper may be referred to as "an image forming medium" in this specification according to circumstances.

The image forming apparatus for the above-described usage comprises: an image forming unit for forming an image by using a development material such as toner; a paper feeding portion for supplying paper to this image forming unit; a paper carrying portion for carrying the supplied paper; and a paper feed/paper carriage controlling portion for controlling supply/carriage of the paper to the image forming unit by the paper feeding portion and the paper carrying portion. The image forming unit includes: an image bearer for accreting the development material to be borne as an image after obtaining a latent image of an optical image formed through an optical system; a development unit for developing the latent image borne by this image bearer as an image by the development material; a transfer unit for transferring the developed image onto the paper; and a fixation unit for fixing the transferred image.

The fixation unit includes a heat roller and a press roller which sandwich the image forming medium carried by the transfer unit on the upstream side and rotate. A heat lamp for heating is provided in each of the heat roller and the press roller, and thermistors for detecting a surface temperature of each roller are provided in the vicinity of the both rollers.

The control operation for a temperature for fixing the development material in the image forming apparatus having the above-described structure will now be schematically described with reference to a flowchart of FIG. 1. In FIG. 1, the processing operation for selecting a type of the image forming medium is first carried out in accordance with a user's choice (step ST1). In the step ST2, the type of the image forming medium is then determined, and a set temperature T is set in the fixation unit in accordance with the paper type in the step ST3. When the fixation temperature is set, a fixation temperature control sequence is started so that the temperature management is performed in accordance with a predetermined sequence in the step ST4.

In FIG. 1, as to the set temperature T, a set value is adjusted by using an adjustment sequence in the adjustment mode. The step ST10 in this adjustment sequence includes the adjustment mode step ST11 for setting the fixation temperature and the adjustment mode step ST13 for setting a fixation drive speed. When setting of the fixation temperature starts in the step ST11, the set value is stored in the step ST12 and the value is supplied as the set temperature T in the step ST3.

Upon starting control of the adjustment mode step ST13, the set value of the fixation drive speed is set in the step ST13, and the set value is stored in the step ST14. This set value is used for setting a standard speed S of the fixation drive speed in the step for setting the fixation drive speed S in the step ST15. The standard speed S of the drive speed is set separately from setting of the fixation temperature T in the step ST3. In the adjustment sequence in the step ST10, the fixation temperature T and the drive speed S are separately set without correlation, and only the set value of the fixation temperature T is taken in the control sequence. Therefore, the set value for the fixation drive speed is not used in the conventional control sequence.

Although the fixation unit fuses and fixes onto the paper the toner electrostatically absorbed on the paper, an appropriate temperature for fixation varies depending on a thickness of the paper. In case of a color image formed by using a color development material, a color having a predetermined gradation is formed by superimposing toners having different colors, e.g., yellow (Y), magenta (M), cyan (C). That is, toners having different colors are superimposed and fused to be mixed, thereby obtaining a desired color. Therefore, a temperature for fusing this color toner and a speed for fixing the toner are not separately controlled, but a technique for correlating them with each other to be fine-adjusted is demanded.

In particular, when forming an image on the surface of such as a transparent sheet used for an OHP (Over-Head Projector) and the like or forming an image on thicker paper than the plain paper, the optimum temperature management is required. Therefore, when forming an image on the image forming medium such as the thick paper or the transparent sheet, a fixation temperature optimum for the image forming medium chosen in the paper selection is fine-adjusted in advance, and an optimum temperature for each medium is set.

As a prior art relating to control over the fixation temperature and the fixation speed in such a fixation device, there are image forming apparatuses disclosed in Japanese patent application laid-open No. 138789-1994, Japanese patent application laid-open No. 219292-1995, Japanese patent application laid-open No. 220928-1996 and others. The first prior art is a technique for preventing a non-paper passing portion of the fixation roller from being unnecessarily heated; the second prior art, a technique for adjusting the fixation speed and the transfer speed in a transfer drum in accordance with each paper type; and the third prior art, a technique for preventing the fixation temperature from falling when passing the long recording paper.

In the prior art including the above-described literatures, since the heat roller and the press roller which are provided to the fixation unit thermally expand so that diameters of them increase when the fixation temperature becomes high, the speed for carrying the paper increases. When this speed exceeds the transfer speed of the transfer belt on the upstream side, the paper being carried is pulled, which generates a minute displacement at a part where transfer is carried out on the paper. Therefore, even if displacement or color shift is not generated on the part of paper where image formation was carried out earlier, displacement or color shift occurs on the part of paper where image formation was performed later, and the image formation accuracy in the entire one sheet of paper is deteriorated.

In particular, in a color image forming apparatus in which both an exposure device and a photosensitive body are united as one and multiple kinds of development materials are held in each development unit and copulatively changed over so that superimposed images are formed on the photosensitive drum, since supply positions of development materials supplied from a plurality of development units provided in accordance with respective colors are subtly displaced for example, there is a problem that displacement or color shift becomes prominent at the part of the paper where the image formation is delayed.

Further, in cases where the speed for carrying the image forming medium in the fixation unit increases even in an image forming apparatus which holds only the black development material and develops and fixes a monochrome image and there is a difference between the carriage speed and the development speed in the development unit, there occurs blur of an image or displacement of an image formation position on the part of paper where image formation is delayed, which leads to a problem such that a desired image can not be obtained.

In this manner, when a difference between the drive speed of the roller in the fixation unit and the transfer speed in the transfer unit becomes large, blur or displacement is generated on the entire sheet of paper having an imaged formed thereon.

In particular, in a color image forming apparatus in which image forming stations are arranged in parallel by a quadruple tandem mode, since a plurality of development portions supply development materials of multiple colors to the photosensitive drums for the respective colors so that images for respective colors are developed to be then transferred onto the transfer belt, displacement is prominently produced at image forming positions for respective colors to be transferred on the transfer belt when the paper carriage speed of the fixation unit increases, which results in that displacement becomes even more striking. Consequently, the color superimposition displacement becomes more prominent.

SUMMARY OF THE INVENTION

In order to solve the above-described problems, an object of the present invention is to provide an image forming apparatus capable of improving the image formation accuracy on the entire one sheet of paper by controlling a rotational velocity of a constituent element such as a heat roller or a press roller in a fixation unit whose diameter thermally expands to increase a speed for carrying an image formation medium with taking a control value based on a temperature detection value detected by the both rollers into consideration. That is, displacement or color shift is prevented at the part of paper where image formation is deteriorated in a color image forming apparatus, and color superimposition displacement is also avoided at image formation positions for respective colors to be transferred onto a transfer belt. In addition, even in case of an image forming apparatus for developing and fixing a monochrome image, blur of an image or displacement of an image forming position is prevented on the side where image formation is delayed.

To achieve this aim, an image forming apparatus according to a basic structure of the present invention is an image forming apparatus for controlling a fixation speed by fine adjustment in accordance with control of a fixation temperature, comprising: medium supplying means for supplying an image forming medium at a constant supply speed; image forming means for forming a predetermined image by using a development material based on inputted image information and holding it by an image bearer; carrying means for carrying the image forming medium supplied to the image forming means; transferring means for transferring the development material formed on the image bearer as an image by the image forming means onto the carried image forming medium; fixing means for heating the transferred development material to be fused by heating member and fixing the development material on the image forming medium; and controlling means for controlling a medium supply speed of the medium supplying means, a medium carriage speed of the carriage means, and an optimum fixation temperature of the fixing means in accordance with a type, a material and a thickness of the image forming medium, and for fine-adjusting a fixation speed of the heating member for carrying the image forming medium while following the fixation temperature whose setting varies depending on a type, a material and a thickness of the image forming medium.

In the image forming apparatus according to a first aspect of the present invention, the controlling means changes the fixation speed substantially in inverse proportion to increase of the fixation temperature so as to maintain a relative speed relationship between a transfer belt constituting the transferring means and the fixation speed of the heating means of the fixing means in the image forming apparatus according to the above-described basic structure.

In the image forming apparatus according to the first aspect, the controlling means may fine-adjust a set value for a drive speed set at the time of image formation in accordance with set values for a type, a material and a thickness of the image forming medium.

In the image forming apparatus according to the first aspect, the controlling means may fine-adjust a set value for the drive speed of the fixing means based on a measurement result measured by a temperature detection portion which is provided to the fixing means and detects a temperature of the heating member.

In the image forming apparatus according to the first aspect, the image forming means may be constituted by a plurality of image formation units provided in parallel with a transfer belt provided to the transferring means, and development materials of different colors may be filled in the respective image formation units.

In the image forming apparatus according to the first aspect, the controlling means comprises: an element for determining a type, a material and a thickness of the image forming medium; a speed set value calculation element for calculating/storing a set value for the drive speed based on a standard speed and a plurality of medium type speed correction values for setting a fixation drive speed in an adjustment mode; an element for starting the drive of a drive portion of the fixing means at the standard speed to set and change an actual drive speed of the fixing means based on a set value for a drive speed calculated by the speed set value calculation element; an element for performing fixation and heating by the heating member of the fixing means under the set actual drive speed; a temperature detection element for detecting a temperature of the heating member; a temperature set value calculation element for calculating/storing a set value for the fixation temperature based on a standard temperature and a plurality of medium type temperature correction values for setting a fixation temperature in an adjustment mode; and an element for judging whether an actual temperature of the image forming medium falls within an appropriate temperature allowable range by inputting the temperature set value calculated by the temperature set value calculation element and a temperature of the heating member detected by the temperature detection element, and for re-heating the heating member when it is out of the range, and for stopping the heating to control the fixation drive speed if it is within the range.

In the image forming apparatus according to the first aspect, detecting means for automatically detecting a type, a material and a thickness of the image forming medium is provided on the upstream side of carriage of the fixing means, and the controlling means may automatically fine-adjust the fixation speed following a change in the fixation temperature.

In the image forming apparatus according to a second aspect of the present invention, the controlling means may change the fixation speed by using a predetermined value previously set for each set value of the fixation temperature and controls to maintain the relative speed relationship between a transfer belt constituting the transferring means and the fixation speed of the heating means of the fixation means constant in the image forming apparatus according to the above-described basic structure.

In the image forming apparatus according to the second aspect, the controlling means may fine-adjust a set value for the drive speed which is set at the time of image formation in accordance with set values for a type, a material and a thickness of the image forming medium.

In the image forming apparatus according to the second aspect, the controlling means may fine-adjust a set value of the drive speed of the fixing means based on a measurement result measured by a temperature detection portion which is provided to the fixation means and detects a temperature of the heating member.

In the image forming apparatus according to the second aspect, the image forming means may be constituted by a plurality of image formation units provided in parallel with a transfer belt provided to the transferring means, and development materials of different colors may be filled in the respective image formation units.

In the image forming apparatus according to the second aspect, the controlling means may comprise: an element for determining a type, a material and a thickness of the image forming medium; a speed set value calculation element for calculating/storing a set value for the drive speed based on a standard speed and a plurality of temperature correction values gradually decreased every a fixed value for setting a fixation drive speed in an adjustment mode; an element for starting the drive of a drive portion of the fixing means at the standard speed and setting and changing an actual drive speed of the fixing means based on a set value for the drive speed which is gradually decreased every the correction value calculated by the speed set value calculation element; an element for performing fixation and heating by the heating member of the fixing means under the set actual drive speed; a temperature detection element for detecting a temperature of the heating member; a temperature set value calculation element for calculating/storing a set value for the fixation temperature based on a standard temperature and a plurality of medium type temperature correction values for setting a fixation temperature in the adjustment mode; and an element for judging whether an actual temperature of the image forming medium falls within an appropriate temperature allowable range by inputting the temperature set value calculated by the temperature set value calculation element and a temperature of the heating member detected by the temperature detection element, and for re-heating the heating member if it is out of the range, and for stopping the heating if it is within the range.

In the image forming apparatus according to the second aspect, detecting means for automatically detecting a type, a material and a thickness of the image forming medium may be provided on the upstream of carriage of the fixing means, and the controlling means may automatically fine-adjust the fixation speed following a change in the fixation temperature based on a type, a material and a thickness of the image forming medium detected by the detecting means.

In the image forming apparatus according to a third aspect of the present invention, the controlling means changes the fixation speed at a predetermined ratio in accordance with each set value of the fixation temperature and controls to constantly maintain the relative speed relationship between a transfer belt constituting the transferring means and the fixation speed of the heating means for the fixing means in the image forming apparatus according to the basic structure.

In the image forming apparatus according to the third aspect, the controlling means may fine-adjust a set value for the drive speed set at the time of image formation in accordance with set values for a type, a material and a thickness of the image forming medium.

In the image forming apparatus according to the third aspect, the controlling means may fine-adjust a set value for the drive speed of the fixing means based on a measurement result measured by a temperature detection portion which is provided to the fixing means and detects a temperature of the heating member.

In the image forming apparatus according to the third aspect, the image forming means may be constituted by a plurality of image formation units provided in parallel with a transfer belt provided to the transferring means, and development materials of different colors may be filled in the respective image formation units.

In the image forming apparatus according to the third aspect, the controlling means may comprise: an element for determining a type, a material and a thickness of the image forming medium; a speed set value calculation element for calculating/storing a set value for the drive speed based on a standard speed and a plurality of temperature correction values gradually decreased at a predetermined speed reduction ratio for setting a fixation drive speed in an adjustment mode; an element for starting the drive of a drive portion of the fixing means at the standard speed and setting and changing an actual drive speed of the fixing means based on the set value of the drive speed which is gradually decreased every the correction value calculated by the speed set value calculation element; an element for performing fixation and heating by the heating member of the fixing means under the set actual drive speed; a temperature detection element for detecting a temperature of the heating member; a temperature set value calculation element for calculating/storing a set value for the fixation temperature based on a standard temperature and a plurality of medium type temperature correction values for setting a fixation temperature in the adjustment mode; and an element for judging whether an actual temperature of the image forming medium falls within an appropriate temperature allowable range by inputting the temperature set value calculated by the temperature set value calculation element and a temperature of the heating member detected by the temperature detection element, and for re-heating he heating member if it is out of the range, and for stopping the heating if it is within the range.

In the image forming apparatus according to the third aspect, detecting means for automatically detecting a type, a material and a thickness of the image forming medium may be provided on the upstream side of carriage of the fixing means, and the control means may automatically fine-adjust the fixation speed following a change in the fixation temperature based on a type, a material and a thickness of the image forming medium detected by the detecting means.

The image forming apparatus according to a second basic structure of the present invention is an apparatus for controlling a fixation speed by fine adjustment in accordance with control of a fixation temperature, comprising: a medium supply unit for supplying an image forming medium at a constant supply speed; an image formation unit for forming a predetermined image by using a development material based on inputted image information to be held it by an image bearer; a carriage unit for carrying the image forming medium supplied to the image formation unit; a transfer unit for transferring the development material formed on the image bearer as image by the image formation unit onto the image forming medium; a fixation unit for heating the transferred development material by a heating member to be fused and fixing the development material on the image forming medium; and a control circuit for controlling a medium supply speed of the medium supply unit, a medium carriage speed of the carriage unit, and an optimum fixation temperature of the fixation unit in accordance with a type, a material and a thickness of the image forming medium, and for fine-adjusting a fixation speed of the heating member for carrying the image forming medium while following the fixation temperature whose setting varies depending on a type, a material and a thickness of the image forming medium.

With the above-described structure, according to the image forming apparatus of the present invention, when a diameter of the fixation roller may expand due to heating by the heating member of the fixation unit to increase a fixation speed, a change in speed is previously fine-adjusted in accordance with a type, a material, a thickness and others of the image forming medium, and it is hence possible to prevent pull or slack of the image forming medium caused due to increase in a temperature as well as dislocation or color shift in image formation.

BRIEF DESCRIPTION OF THE PREFERRED EMBODIMENTS

Preferred embodiments of an image forming apparatus according to the present invention will be described in detail hereunder with reference to the accompanying drawings. The overall structure of a tandem color image forming apparatus will be first explained based on FIGS. 2 and 3, and the operation in first to third embodiments will be then described with reference to flowcharts and characteristic views of FIGS. 4 to 8.

Figure 1:
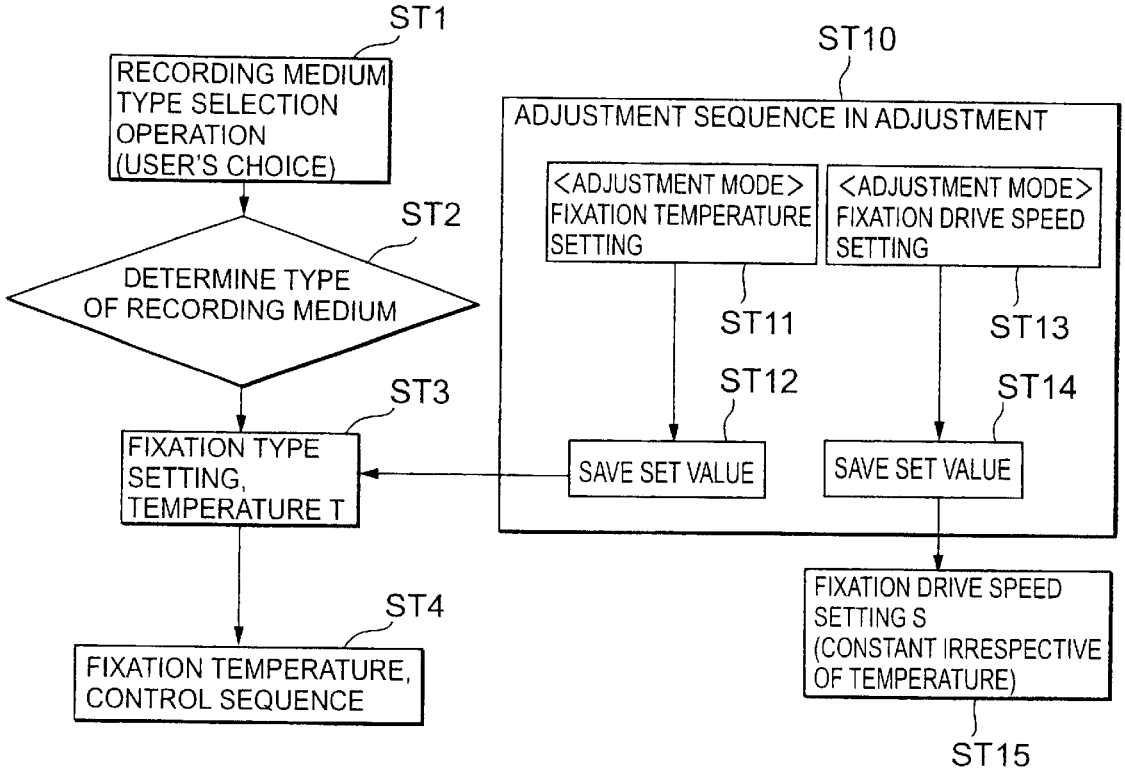
FIG.1 PRIOR ART
FIG. 1 is a flowchart showing a conventional process for setting a fixation temperature.
Figure 2:
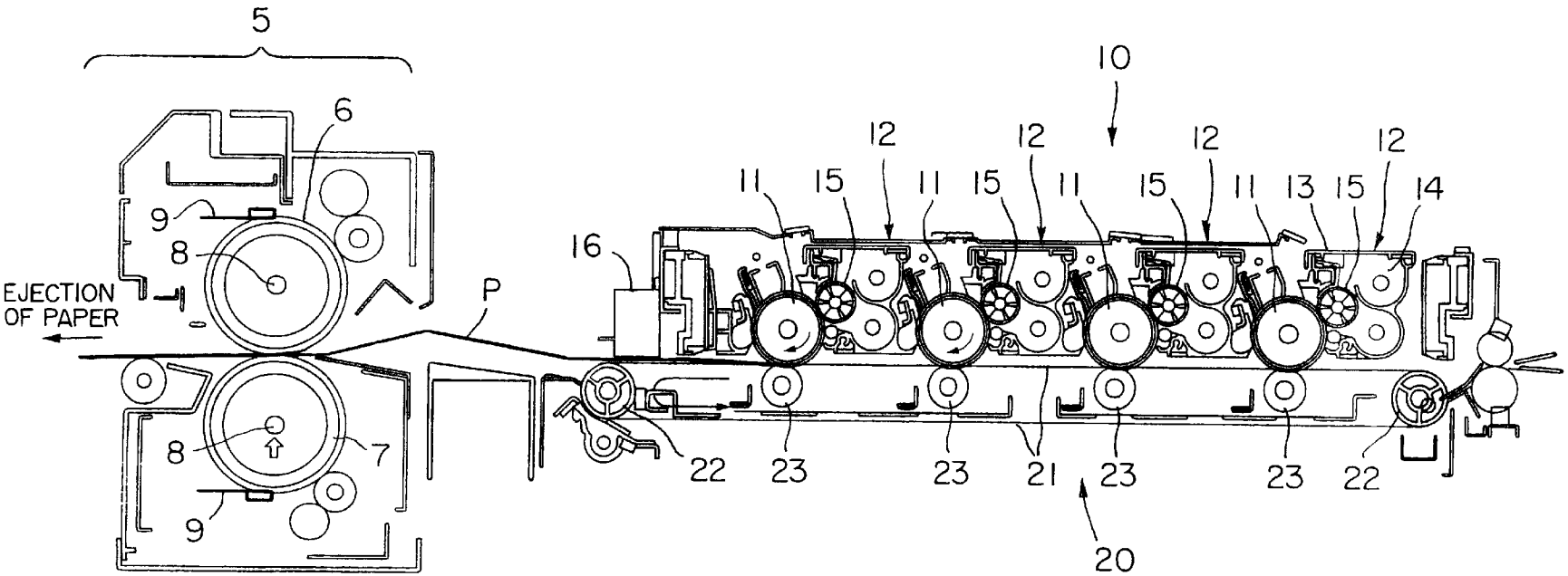
FIG. 2 is a cross-sectional view showing arrangement of a transfer unit and a fixation unit.
Figure 3:
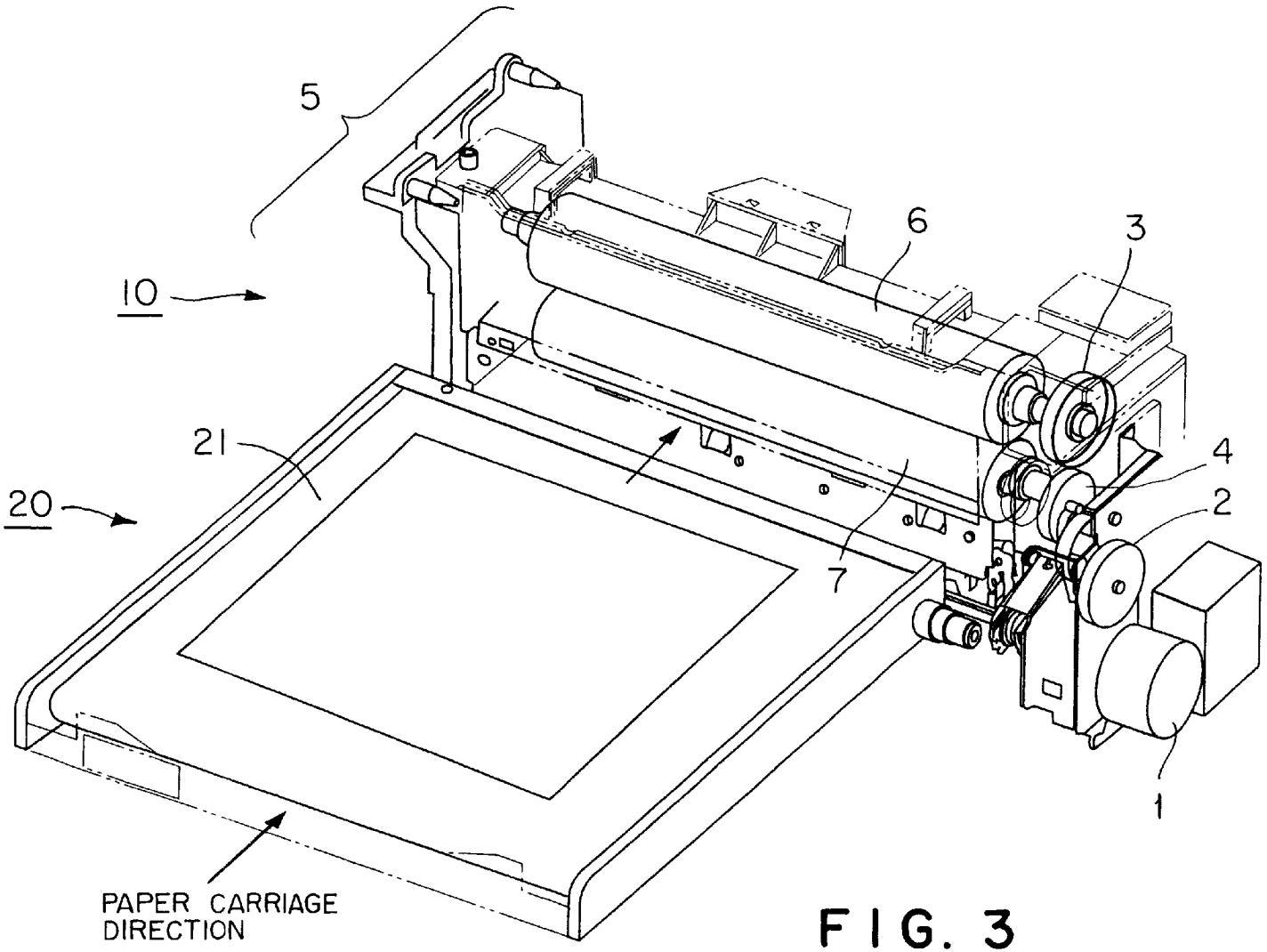
FIG. 3 is a perspective view in which the both units of FIG. 2 are looked down.

The structure of a tandem color image forming apparatus will be first described in conjunction with FIGS. 2 and 3. In FIG. 2, an image formation unit 10 such that the present invention is applied to a tandem copying machine has a basic structure consisting of four pairs of four photosensitive drums 11 and four developers 12, and the developer 12 includes: a developer case 13; and a development material accommodating portion 14 which is provided in the case 13 and accommodates therein a development material such as toner; a development roller 15 for supplying the toner as a development material from the development material accommodating portion 14 to the peripheral surface of the photosensitive drum 11; and a registration sensor 16 for detecting displacement and color shift when an image to be formed is recorded on paper P, as denoted by reference numerals at the rightmost end.

The four developers 12 are provided in accordance with respective four development materials constituted by, e.g., color toner of yellow (Y), magenta (M) and cyan (C) and monochrome toner of black (K). With such a structure, in case of forming a color image having multiple gradations, a color shade of an original is reproduced by superimposing three colors of Y, M and C at predetermined ratios, and in case of forming a monochrome image, an image is formed by using the black color (K) toner.

A transfer unit 20 is provided on the lower side of the image formation unit 10, and this transfer unit 20 includes: a transfer belt 21 which transfers an image formed by the image forming apparatus to the supplied paper P and carries the paper P in the edgeless form; a drive roller 22 for rotating and driving this transfer belt 21; and four transfer rollers 23 for transferring an image formed on a corresponding photosensitive drum to the paper P. It is to be noted that, in FIG. 2, the paper P is supplied from the right side in the drawing and supplied and carried to the left direction in the drawing between the image formation unit 10 and the transfer unit 20 and the paper P is ejected as indicated by an arrow after fixation.

An image transferred on the paper P by the image formation unit 10 and the transfer unit 20 is supplied to the fixation unit 5 where the image is fixed. This fixation unit 5 includes: an upper heat roller 6 rotated and driven while being heated; a press roller 7 which is rotated and driven while being heated and pushes the paper P against the heat roller 6; a heat lamp 8 which is provided on the inner side of the heat roller 6 and the press roller 7 and heats these rollers 6 and 7; and a temperature detection sensor 9 such as a thermistor for detecting temperatures of the rollers 6 and 7.

The perspective view of FIG. 3 shows the image formation unit 10 having the structure of FIG. 2, the image formation unit 10 being looked down. An arrow in the drawing indicates a direction for carrying the paper, and the paper (not shown in FIG. 3) having the image transferred on the transfer belt 21 of the transfer unit 20 is supplied between the heat roller 6 and the press roller 7 of the fixation unit 5. When the paper is sandwiched between the press roller 6 and the heat roller 7 to be heated, the toner as the development material is fused and fixed.

It is to be noted that reference numeral 1 denotes a fixer drive motor for rotating and driving the both rollers 6 and 7; 2, a drive force transmission system for transmitting the drive force from the motor 1 to the rollers 6 and 7; 3, a drive gear for driving the heat roller 6; and 4, a drive gear for driving the press roller 7. The rotational drive force is transmitted to the drives 3 and 4 through the transmission system 2 by supplying a predetermined rotational speed control signal to the drive motor 1 to be controlled, and the paper can be carried while fusing and fixing the development material by rotating and driving the heat roller 6 and the press roller 7 in synchronism with each other.

In the image formation unit having the above-described structure, there are some problems when a heating temperature in the fixation unit is controlled in order to heat/fuse the development material while matching the carriage speeds of the transfer unit 20 and the fixation unit 5. For example, when the fixation speed is set to a very low speed on the safe side, the fixation unit 5 does not have to forcibly pull out the paper from the transfer unit 20 and the image formation position is not displaced even if the heat roller 6 or the press roller 7 thermally expands so that the diameters of the both rollers increases and the speed for carrying the paper becomes high to some extent which results in that the speed for sending the paper from the transfer unit 20 side does not math with the speed for pulling the paper by the fixation unit 5.

In this case, however, since the carriage speed on the fixation unit 5 side is delayed from the carriage speed of the transfer unit when the fixation unit 5 side does not thermally expand, slack of the paper such as shown in FIG. 2 is generated between the fixation unit 5 and the transfer unit 20, and contact made between the peripheral components and the paper produces an "image friction" phenomenon formed by an unfixed development material.

In particular, in the color image forming apparatus, since a registration sensor 16 as a shift detector provided for controlling color superimposition shift is so arranged as to be opposed to the surface of the transfer belt 21 in close proximity, a gap between the surface of the passing paper and the registration sensor 16 is set narrow, and a spatial margin is not assured. Therefore, the isolation distance between the transfer unit 20 and the fixation unit 5 can not be satisfactorily assured. When slack on this part of the paper is absorbed on the safe side, the size of the entire apparatus increases, and the efficiency of the space utilized by a user may be consequently limited.

Therefore, in the image forming apparatus according to the present invention, the relative relationship between the standard transfer belt and the carriage speed of the fixer is set as a reference, and the paper carriage speed of the fixing portion is changed by fine adjustment control in accordance with a variation in a fixation temperature so that the relationship of the relative speed can be substantially constantly maintained.

As apparent from FIGS. 2 and 3, the basic structure of the image forming apparatus according to the present invention provides an image forming apparatus which controls a fixation speed by fine adjustment in accordance with control of a fixation temperature, comprising: medium supplying means for supplying an image forming medium P at a predetermined supply speed; image forming means 10 for forming a predetermined image by using a development material based on inputted image formation and holding the image by an image bearer 11; carrying means 23 for carrying the image forming medium P supplied to the image forming means 10; transferring means 20 for transferring the development material formed as an image on the image bearer 11 by the image forming means 10 onto the image forming medium P; fixing means 5 which heats and fuses the transferred development material by heating members 6 and 7 and fixes the development material on the image forming medium P; and controlling means which controls a medium supply speed of the medium supplying means, a medium carriage speed of the carrying means 23, and an optimum fixation temperature of the fixing means 5 in accordance with a type, a material and a thickness of the image forming medium P and fine-adjusts fixation speeds of the heating members for carrying the image forming medium while following the fixation temperature whose setting changes in accordance with a type, a material and a thickness of the image forming medium. The operation of fine adjustment control by this controlling means will now be described in detail hereinafter in conjunction with first to third embodiments.

Figure 4:
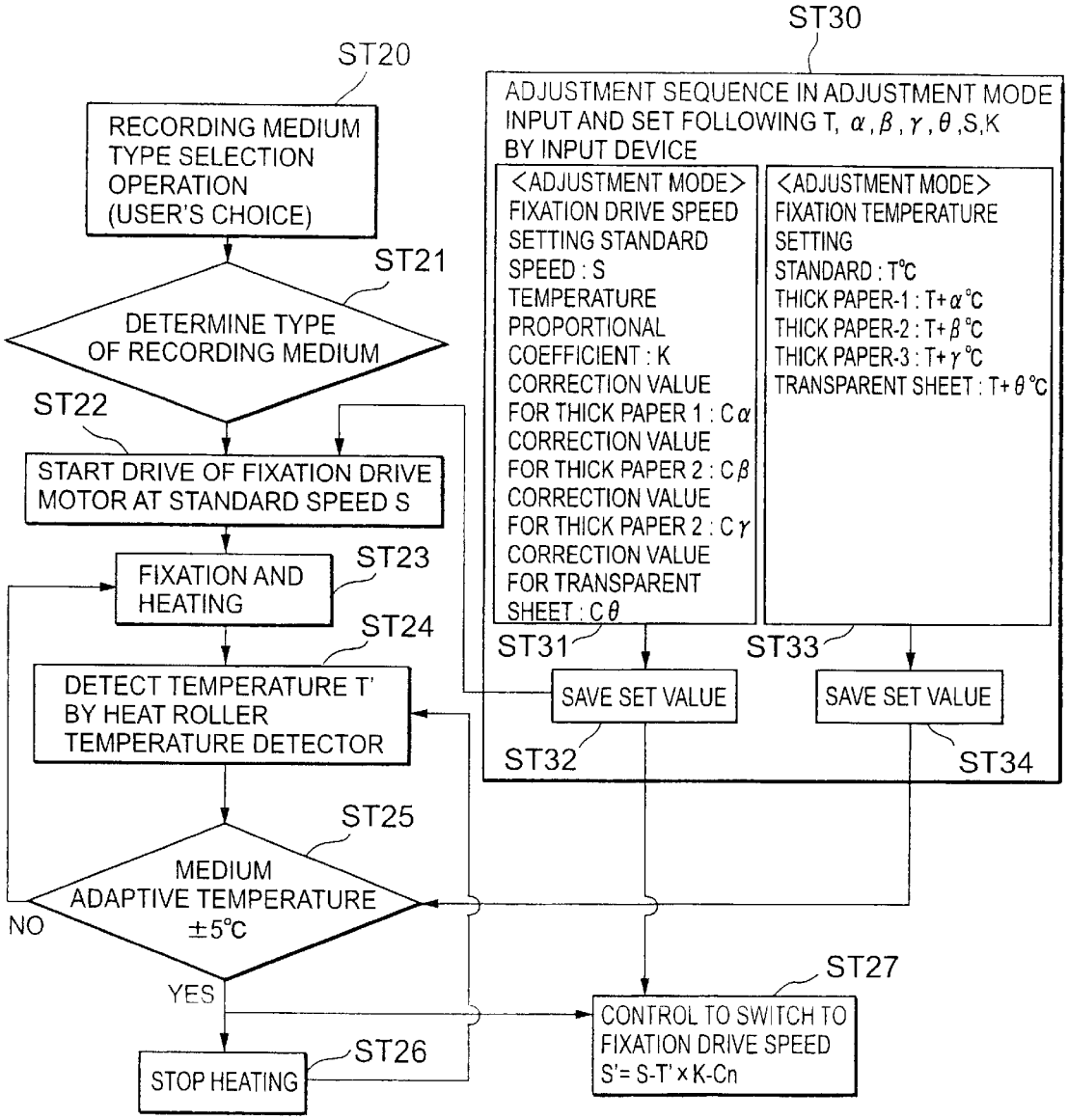
FIG. 4 is a flowchart of the operation of fine adjustment control for a fixation speed matched with a fixation temperature, illustrating the operation of an image forming apparatus according to a first embodiment according to the present invention.

FIG. 4 is a flowchart for explaining the operation of an image forming apparatus according to a first embodiment of the present invention. In the image forming apparatus according to the first embodiment, the controlling means changes the fixation speed substantially in inverse proportion to increase in the fixation temperature and controls in such a manner that a relative speed relationship between the transfer belt constituting the transferring means and the fixation speed of the heating means of the fixation means is constantly maintained.

In the flowchart of FIG. 4, the controlling means comprises: a step ST20 for selecting a type of an image forming medium by a choice of a user; a step ST21 for determining a type, a material and a thickness of the image forming medium; a step ST30 as an adjustment sequence for setting a fixation drive speed in an adjustment mode; a step ST31 as a speed set value calculation element for calculating a set value for the drive speed based on a standard speed and a plurality of medium type speed correction values in the step ST30; a step ST32 for storing the set value for the drive speed; a step ST22 for starting the drive of a drive portion of the fixing means at the standard speed to set and change an actual drive speed of the fixing means based on the set value for the drive speed calculated in the step ST31 as a speed set value calculation element; a step ST23 for performing fixation and heating by the heating member of the fixing means under the set actual drive speed; a temperature detection step ST24 for detecting a temperature of the heating member; a step ST33 as a temperature set value calculation element for calculating a set value for the fixation temperature based on a standard temperature and a plurality of medium type temperature correction values for setting a fixation temperature in the step ST30 in the adjustment mode; a step ST34 for storing the set value calculated in the step ST33; a step ST25 for making a judgment upon whether an actual temperature of the image forming medium P falls within an appropriate temperature allowable range by inputting the temperature set value calculated in the temperature set value calculation step ST33 and outputted in the step ST34 and a temperature of the heating member detected by the temperature detection step ST24; a step ST26 for re-heating the heating member if the actual temperature is out of the allowable range; and a step ST27 for stopping heating to control the fixation drive speed if the actual temperature is within the allowable range.

In the image forming apparatus according to the first embodiment, the controlling means may fine-control the set value for the drive speed which is set at the time of image formation in accordance with set values for a type, a material and a thickness of the image forming medium.

In the image forming apparatus according to the first embodiment, the controlling means may fine-adjust a set value for a drive speed of the fixing means based on a measurement result measured by a temperature detection portion which is provided to the fixing means and detects a temperature of the heating member.

In the image forming apparatus according to the first embodiment, the image forming means may be constituted by a plurality of image formation units provided in parallel with the transfer belt provided to the transferring means, and development materials of different colors may be filled in the respective image formation units.

In the image forming apparatus according to the first embodiment, detecting means for automatically detecting a type, a material and a thickness of the image forming medium may be provided on the upstream side of carriage by the fixing means, and the controlling means may automatically fine-adjust the fixation speed following a change in the fixation temperature based on a type, a material and a thickness of the image forming medium detected by the detecting means.

Figure 7:
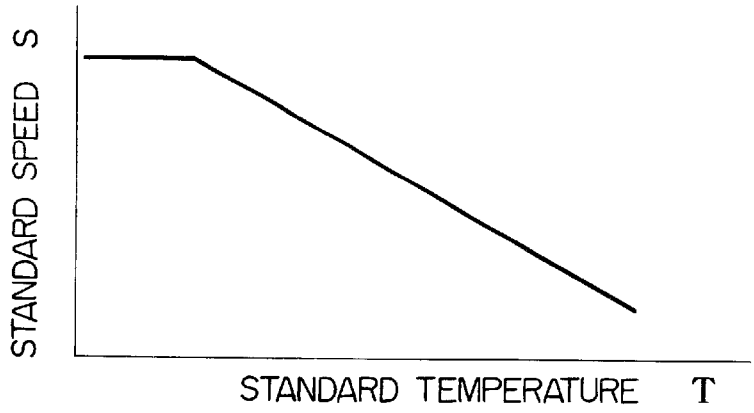
FIG. 7 is a characteristic view showing the state in which fine adjustment control for a fixation speed in the first embodiment is continuously changed in the analog manner.

FIG. 7 shows the correlation between a standard speed S and a standard temperature T of the image forming apparatus according to the first embodiment having the above-described structure. Since the relationship between the standard speed S and the standard temperature T is the proportionality relation and the speed is decreased in inverse proportion to increase in the temperature, the correlation waveform having the characteristic shown in the drawing can be obtained.

Figure 5:
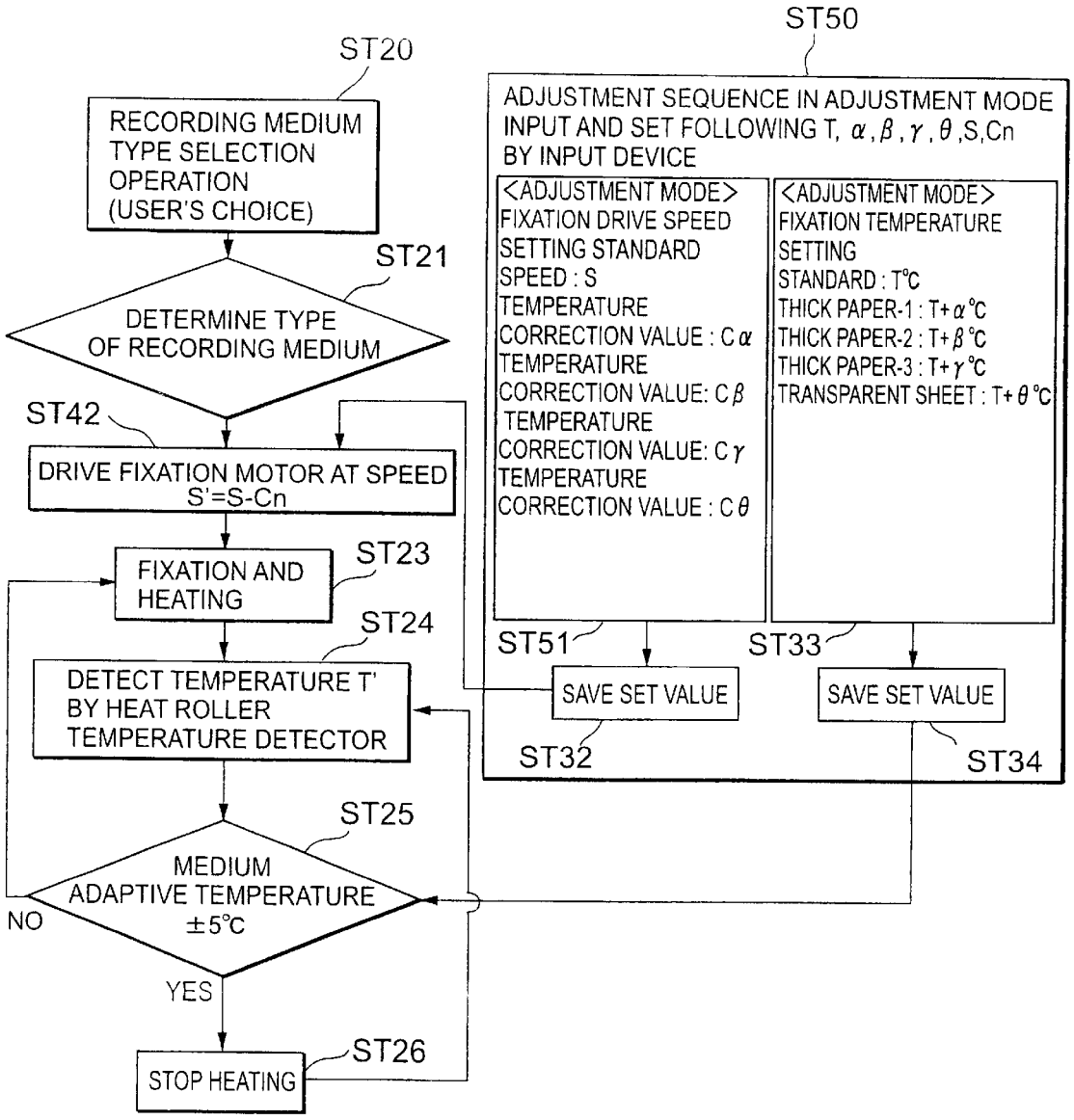
FIG. 5 is a flowchart of the operation of fine adjustment control of a fixation speed matched with a fixation temperature, illustrating the operation of an image forming apparatus according to a second embodiment of the present invention.

The image forming apparatus according to the second embodiment of the present invention will now be described. FIG. 5 is a flowchart for explaining the operation of the image forming apparatus according to the second embodiment of the present invention. In the image forming apparatus according to the second embodiment, the controlling means changes the fixation speed by a predetermined value previously set for each set value for the fixation temperature and controls so that the relative speed relationship between the transfer belt constituting the transferring means and the fixation speed of the heating means of the fixing means is constantly maintained. In FIG. 5, like reference numerals denote the similar or same constituent elements in FIG. 4.

Specifically, as shown in FIG. 5, the controlling means comprises: a step ST20 for selecting a type of an image forming medium by a choice of a user; a step ST21 for determining a type, a material and a thickness of the image forming medium; a speed set value calculation step ST51 for calculating a set value for the drive speed based on a standard speed and a plurality of temperature correction values gradually decreased every a fixed value for setting a fixation drive speed in a step ST50 as an adjustment sequence in an adjustment mode; a step ST32 for storing this set value; a step ST42 for starting the drive of a driving portion of the fixing means 5 at the standard speed to set and change an actual drive speed of the fixing means 5 based on a set value for the drive speed which is gradually decreased every the correction value calculated in the speed set value calculation step ST51; a step ST23 for performing fixation and heating by the heating members 6 and 7 of the fixing means 5 under the set actual drive speed; a temperature detection step ST24 for detecting a temperature of the heating member; a temperature set value calculation step ST33 for calculating a set value for the fixation temperature based on a standard temperature and a plurality of medium type temperature correction values for setting the fixation temperature in the step ST50 as a sequence for effecting the adjustment mode; a step ST34 for storing the temperature set value calculated by the step ST33 as a temperature set value calculation element; a step ST25 for judging whether an actual temperature of the image forming medium falls within an appropriate temperature allowable range by inputting the temperature set value calculated by the step ST33 and a temperature of the heating members detected by the temperature detection element; and a step ST26 which returns to the step ST23 to reheat the heating members if the actual temperature is out of the allowable range and stops heating if the actual temperature is out of the allowable range.

In the image forming apparatus according to the second embodiment, the controlling means may fine-adjust a set value for a drive speed set at the time of image formation in accordance with set values for a type, a material and a thickness of the image forming medium.

In the image forming apparatus according to the second embodiment, the controlling means may fine-adjust a set value for a drive speed of the fixing means based on a measurement result measured by a temperature detection portion which is provided to the fixing means and detects a temperature of the heating member.

In the image forming apparatus according to the second embodiment, the image forming means may be constituted by a plurality of image formation units provided in parallel with the transfer belt 23 provided to the transferring means 20, and development materials of different colors may be filled in the respective image formation units.

In the image forming apparatus according to the second embodiment, detecting means for automatically detecting a type, a material and a thickness of the image forming medium is provided on the upstream side of carriage by the fixing means 5, and the controlling means may automatically fine-adjust the fixation speed following a change in the fixation temperature based on a type, a material and a thickness of the image forming medium detected by the detecting means.

Figure 6:
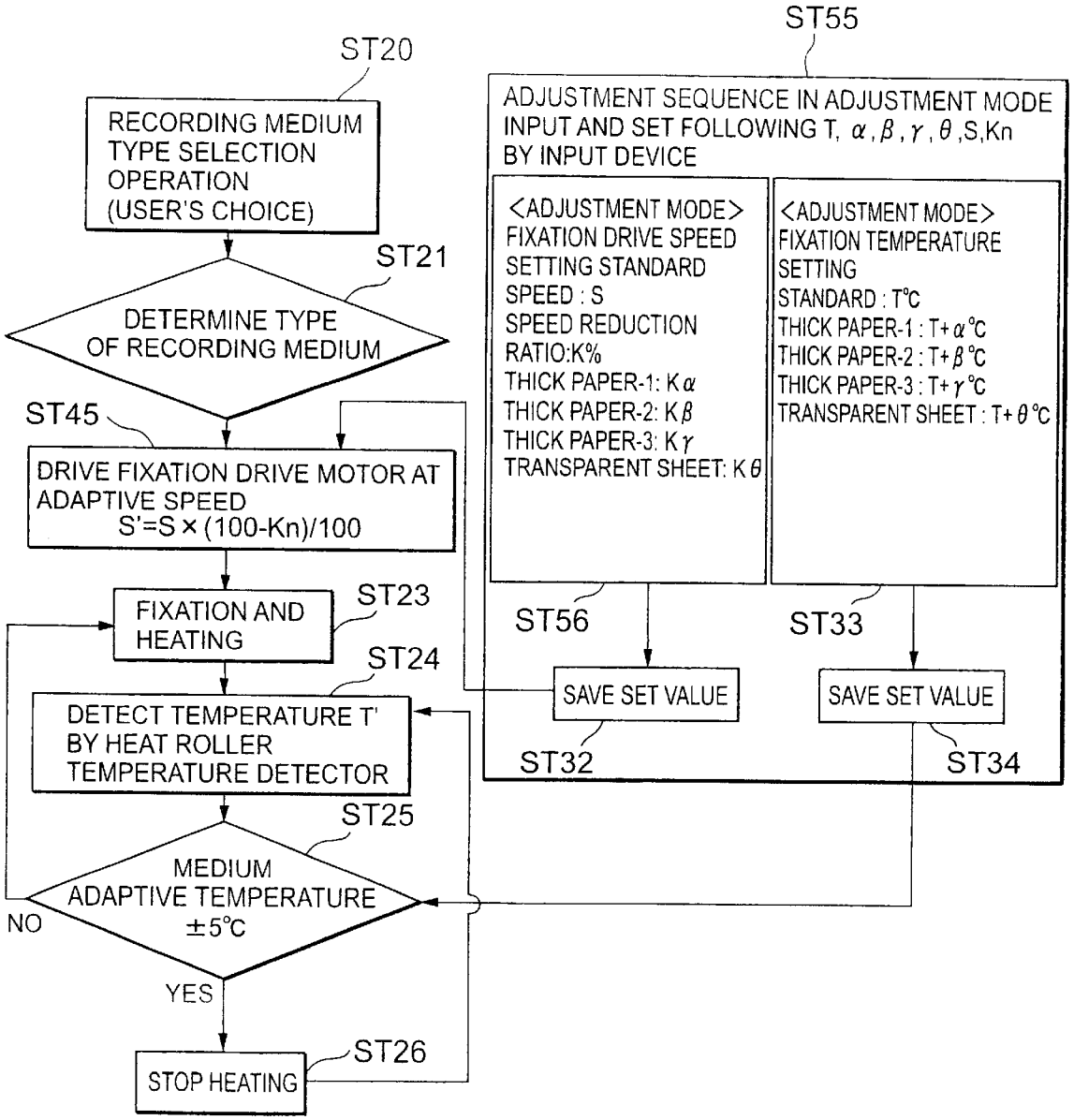
FIG. 6 is a flowchart of the operation of fine adjustment control for a fixation speed matched with a fixation temperature, illustrating the operation of an image forming apparatus according to a third embodiment of the present invention.

An image forming apparatus according to a third embodiment of the present invention will now be described with reference to FIG. 6. FIG. 6 is a flowchart for explaining the operation of the image forming apparatus according to the second embodiment of the present invention. In the image forming apparatus according to the third embodiment, the controlling means changes the fixation speed at a predetermined ratio previously set in accordance with each set value for the fixation temperature and controls in such a manner that the relative speed relationship between the transfer belt constituting the transferring means and the fixation speed of the heating means of the fixing means is constantly maintained. In FIG. 6, like reference numerals denote the similar or same constituent elements in FIGS. 4 and 5.

Specifically, as shown in FIG. 6, the controlling means comprises: a step ST20 for selecting a type of an image forming medium by a choice of a user; a step ST21 for judging a type, a material and a thickness of the image forming medium P; a speed set value calculation step ST56 for calculating a set value for the drive speed based on a standard speed and a plurality of temperature correction values gradually decreased at a predetermined speed reduction ratio for setting a fixation drive speed in a step ST55 as an adjustment sequence in an adjustment mode; a step ST32 for storing this set value; a step ST45 for starting the drive of a drive portion of the fixing means 5 at the standard speed to set and change an actual drive speed of the fixing means 5 based on a set value for a drive speed gradually decreased every the correction value calculated by the speed set value calculation step ST56; a step ST23 for performing fixation and heating by the heating members 6 and 7 of the fixing means under the set actual drive speed; a temperature detection step ST24 for detecting temperatures of the heating members; a step ST33 as a temperature set value calculation element for calculating a set value for the fixation temperature based on a standard temperature and a plurality of medium type temperature correction values for setting a fixation temperature in the adjustment mode; a step ST34 for storing a set value for the fixation temperature; a step ST25 for judging whether an actual temperature of the image forming medium falls within an appropriate temperature allowable range by inputting the temperature set value calculated by the temperature set value calculation step ST33 and actual temperatures of the heating members detected by the temperature detecting means; a step ST23 for re-heating the heating members if the actual temperature is out of the allowable range; and a step ST26 for stopping heating when the actual temperature is within the allowable range.

In the image forming apparatus according to the third embodiment, the controlling means may likewise fine-adjust a set value of the drive speed set at the time of image formation in accordance with set values for a type, a medium and a thickness of the image forming medium.

In the image forming apparatus according to the third embodiment, the controlling means may fine-adjust a set value for the drive speed of the fixing means based on a measurement result measured by a temperature detection portion which is provided to the fixing means and detects temperatures of the heating members.

Further, in the image forming apparatus according to the third embodiment, the image forming means is constituted by a plurality of image formation units provided in parallel with the transfer belt disposed to the transferring means, and development materials of different colors may be filled in the respective image formation units.

Furthermore, in the image forming apparatus according to the third embodiment, detecting means for automatically detecting a type, a material and a thickness of the image forming medium may be provided on the upstream side of carriage of the fixing means, and the controlling means may automatically fine-adjust the fixation speed following a change in the fixation temperature based on a type, a material and a thickness of the image formation medium detected by the detecting means.

Figure 8:
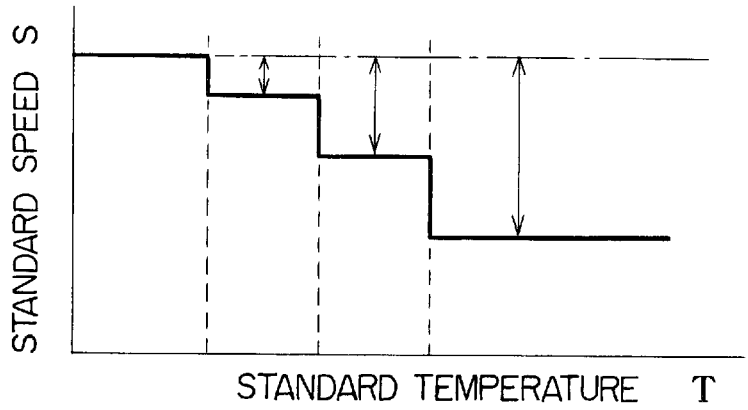
FIG. 8 is a characteristic view showing the state in which fine adjustment control for a fixation speed in the second and third embodiments is switched in the digital manner.

Since the correlations between a standard speed S and a standard temperature T according to the foregoing second and third embodiments have a characteristic such that the standard speed S is gradually decreased in the step-like manner in accordance with each given temperature region in common, they can be represented by the same waveform as shown in FIG. 8. However, as to gradual decrease in the standard speed S in the step-like manner, the standard speed is reduced by a fixed value (a predetermined value) in the second embodiment, whereas it is decreased at a ratio in the third embodiment, and a value in each step of the gradually decreasing level hence differs from each other.

Figure 9:
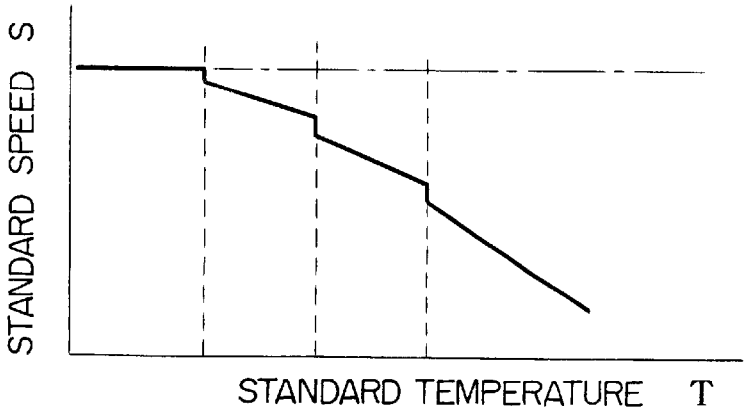
FIG. 9 is a characteristic view showing a fine adjustment control waveform of a fixation speed in an image forming apparatus according to a fourth embodiment.

Although the detailed illustration is refrained, when the idea of the present invention is developed, the image forming apparatus according to a fourth embodiment such as shown in FIG. 9 can be also considered as the correlation between the standard speed S and the standard temperature T. As apparent from this characteristic view, in the fourth embodiment, the controlling means carries out control in such a manner that waveform in case of step-like gradual decrease for each predetermined temperature region and that in case of a ratio which differs depending on each region are indicated in inverse proportion to each other when the controlling means changes the standard speed S with respect to the standard temperature T. Although the correlation between the standard speed S and the standard temperature T is as shown in FIG. 9, control of the image forming apparatus according to the present invention is possible, thereby obtaining a predetermined advantage.

Finally, although illustration is refrained, the image forming apparatus according to the present invention can be realized by a software type program control, but it may be also constituted by an electronic circuit and the like as a hardware structure. An image forming apparatus according to a fifth embodiment in which the present invention is defined by a circuitry as a hardware structure is an image forming apparatus for controlling a fixation speed by fine adjustment in accordance with control of a fixation temperature. This image forming apparatus may comprise: a medium supply unit for supplying an image forming medium at a predetermined supply speed; an image formation unit for forming a predetermined image by using a development material based on inputted image information and holding it by an image bearer; a carriage unit for carrying the image forming medium supplied to the image formation unit; a transfer unit for transferring the development material formed as an image on the image bearer by the image formation unit onto the image forming medium; a fixation unit for heating and fusing the transferred development material by a heating member and fixing the development material on the image forming medium; and a control circuit for respectively controlling a medium supply speed of the medium supply unit, a medium carriage speed of the carriage unit, and an optimum fixation temperature of the fixation unit in accordance with a type, a medium and a thickness of the image forming medium, and for fine-adjusting a fixation speed of the heating member for carrying the image forming medium while following the fixation temperature whose setting changes in accordance with a type, a material and a thickness of the image forming medium.

In the control circuit, each control described in the control flow in the first to third embodiments is carried out, and each step illustrated in FIGS. 4, 5 and 6 is not executed by a program but realized by a hardware structure in the form of an electronic circuit such as a semiconductor chip in this embodiment. In the present embodiment, each step in the flowcharts of FIGS. 4 to 6 may be constituted by each single arithmetic circuit device or by a discrete circuitry.

Incidentally, as to the image forming apparatus according to the foregoing first to fourth embodiments, although the above has described the case where the present invention is implemented by the quadruple tandem color image forming apparatus, the present invention is not restricted thereto and can be applied to a monochrome image forming apparatus for forming a monochrome image by using one-color toner such as black. When the present invention is applied to the monochrome image forming apparatus in this manner, it is possible to control in such a manner inconformity is not produced between the carriage speed for the image forming medium in the fixation unit and the development speed in the development unit based on a temperature detected in advance even if the carriage speed may be increased due to thermal expansion. Further, blur of an image or displacement of an image formation position can be prevented from being generated on the side where image formation on the paper is delayed, thereby obtaining a desired image.

As described above in detail, since the image forming apparatus according to the present invention controls a rotation speed of a constituent element whose carriage speed for the image forming medium is increased due to thermal expansion of a diameter of, e.g., a heat roller or a press roller in the fixation unit with taking a control value based on a temperature detection value detected by the both rollers into consideration, displacement or color shift can be avoided at the part of paper where image formation is delayed in the color image forming apparatus, and color superimposition displacement can be also prevented from occurring at an image formation position for each color to be transferred onto the transfer belt.

Further, even in case of the image forming apparatus for developing and fixing a monochrome image, it is possible to provide an image forming apparatus which can prevent blur of an image or displacement of an image formation position form being generated on the image formation delayed side and improve the image formation accuracy on one entire sheet of paper.

What is claimed is:

1. An image forming apparatus for controlling a fixation speed by fine adjustment in accordance with control of a fixation temperature, comprising:

medium supplying means for supplying an image forming medium at a constant supply speed;

image forming means for forming a predetermined image by using a development material based on inputted image information and holding said image forming medium by an image bearer;

carrying means for carrying said image forming medium supplied to said image forming means;

transferring means for transferring said image development material formed as an image on said image bearer by said image forming means onto said carried image forming medium;

fixing means for heating and fusing said transferred development material by a heating member and fixing said development material on said image forming material; and controlling means for controlling a medium supply speed of said medium supplying means, a medium carriage speed of said carrying means, and an optimum fixation temperature of said fixing means in accordance with a type, a material and a thickness of said image forming medium, and for fine-adjusting a fixation speed of said heating member for carrying said image forming medium in accordance with said fixation temperature whose setting changes in accordance with a type, a material and a thickness of said image forming medium, wherein said controlling means changes said fixation speed so as to be substantially in inverse proportion to increase in said fixation temperature, and controls in such a manner that a relative speed relationship between a transfer belt constituting said transferring means and said fixation speed of said heating means of said fixing means is constantly maintained.

2. The image forming apparatus according to claim 1, wherein said controlling means fine-adjusts a set value for a drive speed set at the time of image formation in accordance with a type, a material and a thickness of said image forming medium.

3. The image forming apparatus according to claim 1, wherein said controlling means fine-adjusts a set value for a drive speed of said fixing means based on a measurement result measured by a temperature detection portion which is provided to said fixing means and detects a temperature of said heating member.

4. The image forming apparatus according to claim 1, wherein said image forming means is constituted by a plurality of image formation units provided in parallel with a transfer belt disposed to said transferring means, and development materials of different colors are filled in said respective image formation units.

5. The image forming apparatus according to claim 1, wherein said controlling means comprises: an element for determining a type, a material and a thickness of said image forming medium; a speed set value calculation element for calculating/storing a set value for said drive speed based on a standard speed and a plurality of medium type speed adjustment values for setting a fixation drive speed in an adjustment mode; an element for starting the drive of a drive portion of said fixing means at said standard speed to set and change an actual drive speed of said fixing means based on a set value for a drive speed calculated by said speed set value calculation element; an element for performing fixation and heating by said heating member of said fixing means under said set actual drive speed; a temperature detection element for detecting a temperature of said heating member; a temperature set value calculation element for calculating/storing a set value for said fixation temperature based on a standard temperature and a plurality of medium type temperature correction values for setting a fixation temperature in said adjustment mode; and an element for judging whether an actual temperature of said image forming medium falls within an appropriate temperature allowable range by inputting said temperature set value calculated by said temperature set value calculation element and a temperature of said heating member detected by said temperature detection element, and for reheating said heating member if said actual temperature is out of said allowable range, and for stopping said heating to control a fixation drive speed if said actual temperature is within said allowable range.

6. The image forming apparatus according to claim 5, wherein detecting means for automatically detecting a type, a material and a thickness of said image forming medium is provided on the upstream side of carriage of said fixing means, and said controlling means automatically fine-adjusts said fixation speed following a change in said fixation temperature based on a type, a material and a thickness of said image forming medium detected by said detecting means.

7. An image forming apparatus for controlling a fixation speed by fine adjustment in accordance with control of a fixation temperature, comprising:

medium supplying means for supplying an image forming medium at a constant supply speed;

image forming means for forming a predetermined image by using a development material based on inputted image information and holding said image forming medium by an image bearer;

carrying means for carrying said image forming medium supplied to said image forming means:

transferring means for transferring said image development material formed as an image on said image bearer by said image forming means onto said carried image forming medium;

fixing means for heating and fusing said transferred development material by a heating member and fixing said development material on said image forming material; and controlling means for controlling a medium supply speed of said medium supplying means, a medium carriage speed of said carrying means, and an optimum fixation temperature of said fixing means in accordance with a type, a material and a thickness of said image forming medium, and for fine-adjusting a fixation speed of said heating member for carrying said image forming medium in accordance with said fixation temperature whose setting changes in accordance with a type, a material and a thickness of said image forming medium, wherein said controlling means changes said fixation speed by a predetermined value set in advance in accordance with each set value for said fixation temperature and controls in such a manner that a relative speed relationship between a transfer belt constituting said transferring means and said fixation speed of said heating means of said fixing means is constantly maintained, and wherein said controlling means fine-adjusts a set value for a drive speed of said fixing means based on a measurement result measured by a temperature detection portion which is provided to said fixing means and which detects a temperature of said heating member.

8. An image forming apparatus for controlling a fixation speed by fine adjustment in accordance with control of a fixation temperature, comprising:

medium supplying means for supplying an image forming medium at a constant supply speed;

image forming means for forming a predetermined image by using a development material based on inputted image information and holding said image forming medium by an image bearer;

carrying means for carrying said image forming medium supplied to said image forming means;

transferring means for transferring said image development material formed as an image, on said image bearer by said image forming means onto said carried image forming medium;

fixing means for heating and fusing said transferred development material by a heating member and fixing said development material on said image forming material; and controlling means for controlling a medium supply speed of said medium supplying means, a medium carriage speed of said carrying means, and an optimum fixation temperature of said fixing means in accordance with a type, a material and a thickness of said image forming medium, and for fine-adjusting a fixation speed of said heating member for carrying said image forming medium in accordance with said fixation temperature whose setting changes in accordance with a type, a material and a thickness of said image forming medium, wherein said controlling means changes said fixation speed by a predetermined value set in advance in accordance with each set value for said fixation temperature, and controls in such a manner that a relative speed relationship between a transfer belt constituting said transferring means and said fixation speed of said heating means of said fixing means is constantly maintained, and wherein said controlling means comprises: an element for determining a type, a material and a thickness of said image forming medium; a speed set value calculation element for calculating/storing a set value for said drive speed based on a standard speed and a plurality of temperature correction values gradually decreased every a fixed value for setting a fixation drive speed in an adjustment mode; an element for starting the drive of a drive portion of said fixing means at said standard speed to set and change an actual drive speed of said fixing means based on a set value of a drive speed which is gradually decreased every said correction value calculated by said speed set value calculation element; an element for performing fixation and heating by said heating member of said fixing means under said set actual drive speed; a temperature detection element for detecting a temperature of said heating member; a temperature set value calculation element for calculating/storing a set value for said fixation temperature based on a standard temperature and a plurality of medium type temperature correction values for setting a fixation temperature in said adjustment mode; and an element for judging whether an actual temperature of said image forming medium falls within an appropriate temperature allowable range by inputting said temperature set value calculated by said temperature set value calculation element and a temperature of said heating member detected by said temperature detection element, and for re-heating said heating member if said actual temperature is out of said allowable range, and for stopping the heating if said actual temperature is within said allowable range.

9. An image forming apparatus for controlling a fixation speed by fine adjustment in accordance with control of a fixation temperature, comprising:

medium supplying means for supplying an image forming medium at a constant supply speed;

image forming means for forming a predetermined image by using a development material based on inputted image information and holding said image forming medium by an image bearer;

carrying means for carrying said image forming medium supplied to said image forming means;

transferring means for transferring said image development material formed as an, image on said image bearer by said image forming means onto said carried image forming medium;

fixing means for heating and fusing said transferred development material by a heating member and fixing said development material on said image forming material; and controlling means for controlling a medium supply speed of said medium supplying means, a medium carriage speed of said carrying means, and an optimum fixation temperature of said fixing means in accordance with a type, a material and a thickness of said image forming medium, and for fine-adjusting a fixation speed of said, heating member for carrying said image forming medium in accordance with said fixation temperature whose setting changes in accordance with a type, a material and a thickness of said image forming medium, wherein said controlling means changes said fixation speed at a predetermined ratio set in advance in accordance with each set value for said fixation temperature, and controls in such a manner that a relative speed relationship between a transfer belt constituting said transferring means and said fixation speed of said, heating means of said fixing means is constantly maintained, and wherein said controlling means fine-adjusts a set value for a drive speed of said fixing means based on a measurement result measured by a temperature detection portion which is provided to said fixing means and which detects a temperature of said heating member.

10. An image forming apparatus for controlling a fixation speed by fine adjustment in accordance with control of a fixation temperature, comprising:

medium supplying means for supplying an image forming medium at a constant supply speed;

image forming means for forming a predetermined image by using a development material based on inputted image information and holding said image forming medium by an image bearer;

carrying means for carrying said image forming medium supplied to said image forming means;

transferring means for transferring said image development material formed as an image on said image bearer by said image forming means onto said carried image forming medium;

fixing means for heating and fusing said transferred development material by a heating member and fixing said development material on said image forming material; and controlling means for controlling a medium supply speed of said medium supplying means, a medium carriage speed of said carrying means, and an optimum fixation temperature of said fixing means in accordance with a type, a material and a thickness of said image forming medium, and for fine-adjusting a fixation speed of said heating member for carrying said image forming medium in accordance with said fixation temperature whose setting changes in accordance with a type, a material and a thickness of said image forming medium, wherein said controlling means changes said fixation speed at a predetermined ratio set in advance in accordance with each set value for said fixation temperature, and controls in such a manner that a relative speed relationship between a transfer belt constituting said transferring means and said fixation speed of said heating means of said fixing means is constantly maintained, and wherein said controlling means comprises: an element for determining a type, a material and a thickness of said image forming medium; a speed set value calculation element for calculating/storing a set value for said drive speed based on a standard speed and a plurality of temperature correction values gradually decreased at a predetermined speed reduction ratio for setting a fixation drive speed in an adjustment mode; an element for starting the drive of a drive portion of said fixing means at said standard speed to set and change an actual drive speed of said fixing means based on a set value for a drive speed gradually decreased every said correction value calculated by said speed set value calculation element; an element for performing fixation and heating by said heating member of said fixing means under said set actual drive speed; a temperature detection element for detecting a temperature of said heating member; a temperature set value calculation element for calculating/storing a set value for said fixation temperature based on a standard temperature and a plurality of medium type temperature correction values for setting a fixation temperature in said adjustment mode; and an element for judging whether an actual temperature of said image forming medium falls within an appropriate temperature allowable range by inputting said temperature set value calculated by said temperature set value calculation element and a temperature of said heating member detected by said temperature detection element, and for re-heating said heating member if said actual temperature is out of said allowable range, and for stopping the heating if said actual temperature is within said allowable range.

11. A controlling method in an image forming apparatus, comprising:

selecting a type of an image forming medium by a choice of a user;

judging a type, a material and a thickness of the image forming medium;

calculating a set value for a drive speed based on a standard speed and a plurality of temperature correction values gradually decreased at a predetermined speed reduction ratio for setting a fixation drive speed in an adjustment sequence in an adjustment mode;

storing the set value;

starting a drive of a drive portion of a fixing means at the standard speed to set and change an actual drive speed of the fixing means based on a set value for a drive speed gradually decreased every correction value calculated by the speed set value calculation step;

performing fixation and heating by a heating member of the fixing means under the actual drive speed;

detecting temperatures of the heating member;

calculating a set value for a fixation temperature based on a standard temperature and a plurality of medium type temperature correction values for setting a fixation temperature in the adjustment mode;

storing a set value for the fixation temperature;

judging whether an actual temperature of the image forming medium falls within an appropriate temperature allowable range by inputting the temperature set value calculated in the temperature set value calculation step and actual temperatures of the heating member detected by the temperature detecting means;

re-heating the heating member if the actual temperature is out of the allowable range; and stopping heating when the actual temperature is within the allowable range.

12. The controlling method according to claim 11, wherein a correlation between the standard speed and the standard temperature is determined in a manner in which a step-like waveform gradually decreases for each predetermined temperature region, and in which a ratio which differs depending on each region, are indicated in inverse proportion to each other when the controlling method changes the standard speed with respect to the standard temperature.

* * * * *